US012618642B2

(12) United States Patent
Yan et al.

(10) Patent No.: US 12,618,642 B2
(45) Date of Patent: May 5, 2026

(54) UNIVERSAL HOLSTER

(71) Applicant: Shenzhen Tactop Industrial Co., Ltd., ShenZhen (CN)

(72) Inventors: Mei Yan, ShenZhen (CN); Xiaoli You, ShenZhen (CN)

(73) Assignee: Shenzhen Tactop Industrial Co., Ltd., ShenZhen (CN)

( * ) Notice: Subject to any disclaimer, the term of this patent is extended or adjusted under 35 U.S.C. 154(b) by 81 days.

(21) Appl. No.: 18/822,140

(22) Filed: Aug. 31, 2024

(65) Prior Publication Data

US 2025/0389516 A1 Dec. 25, 2025

(51) Int. Cl.
*F41C 33/02* (2006.01)
*F41C 33/04* (2006.01)

(52) U.S. Cl.
CPC ..... *F41C 33/0209* (2013.01); *F41C 33/045* (2013.01)

(58) Field of Classification Search
CPC .. F41C 33/02; F41C 33/0209; F41C 33/0236; F41C 33/045
USPC ..... 224/243
See application file for complete search history.

(56) References Cited

U.S. PATENT DOCUMENTS 5,931,358 A * 8/1999 Rogers ..... F41C 33/0209 224/245
7,694,860 B2 * 4/2010 Clifton, Jr. ..... F41A 17/00 224/198
9,022,262 B2 * 5/2015 Pellegrini ..... F41C 33/0227 224/912
9,228,802 B2 * 1/2016 Ribas ..... F41C 33/0263
10,317,169 B2 * 6/2019 McKendrick ..... F41C 33/0263
12,092,427 B2 * 9/2024 Kirsch ..... F41C 33/0245
2017/0284755 A1 * 10/2017 Farringer ..... F41C 33/0209
2020/0393214 A1 * 12/2020 De Oliveira Ribas ..... F41C 33/0209

OTHER PUBLICATIONS

"Versatile Gun Holster with Paddle, Fit Most Popular Full Size & Compact Semi-Automatic Pistols, Fit with Springfield Echelon/Sig P365 X Macro/Glock 17 19/CZ/S&W M&P Shield/Ruger/1911/Taurus/HK Handgun" as retrieved from the Following Amazon link on Jul. 19, 2024. Date First Available: Nov. 18, 2023. The inventor(s) is directly responsible for this public disclosure. https://www.amazon.com/dp/B0CNLQ71WP?th=1.

* cited by examiner

*Primary Examiner* — Justin M Larson

(57) ABSTRACT

A universal holster is disclosed, including a sleeve body and a first adjustable component. The sleeve body has a chamber, and the first adjustable component includes a first bracket, a connecting rod, a movable part and an adjustable part. The first bracket is rotationally connected with respect to the sleeve body and one end of the connecting rod is rotationally connected to the first bracket, a rotational connection point between the connecting rod and the first bracket is eccentric to a rotational connection point between the first bracket and the sleeve body, another end of the connecting rod is rotationally connected to the movable part, the adjustable part is connected with the movable part, and the adjustable part is used to drive the movable part for movement. The universal holster can be suitable to different models of pistols.

11 Claims, 5 Drawing Sheets

UNIVERSAL HOLSTER

TECHNICAL FIELD

The present application relates to pistol accessories and in particular to a universal holster.

BACKGROUND

A holster is a pistol accessory used to attach a pistol to one person using it. The holster not only may be used to fit the pistol for easy carrying, but some holsters may also lock the trigger. The holster must fit the models of the pistol, otherwise the pistol will wobble in the holster.

SUMMARY

In view of this, the present disclosure aims to provide a universal holster that can make the holster suitable for different models of pistol.

In some embodiments of the present disclosure, a universal holster is provided, including a sleeve body and a first adjustable component.

The sleeve body has a chamber.

The first adjustable component includes a first bracket, a connecting rod, a movable part and an adjustable part. Herein the first bracket is rotationally connected with respect to the sleeve body and one end of the connecting rod is rotationally connected to the first bracket, a rotational connection point between the connecting rod and the first bracket is eccentric to a rotational connection point between the first bracket and the sleeve body, another end of the connecting rod is rotationally connected to the movable part, the adjustable part is connected with the movable part, and the adjustable part is configured to drive the movable part for movement.

Compared with existing technologies, the universal holster of the present disclosure has at least following beneficial effects and advantages. By adjusting the adjustable part to drive the movable part moving, thereby making the connecting rod movable, the connecting rod will then drive the first bracket to rotate with respect to the sleeve body during moving, thus the angle of the first bracket can be adjusted, so that the first bracket can be made to abut against different models of pistol. Therefore, the universal holster of the present disclosure can be suitable for different models of pistol.

The following specific embodiments will further illustrate the universal holster of the present disclosure in conjunction with the accompanying drawings described above.

DETAILED DESCRIPTION OF THE EMBODIMENTS

The technical solutions in the embodiments of the present disclosure will be clearly and completely described below in conjunction with the accompanying drawings in the embodiments of the present disclosure. Obviously, the described embodiments are only a part of the embodiments of the present disclosure and not all of the embodiments. Based on the embodiments of the present disclosure, all other embodiments obtained by a person of ordinary skill in the art without making creative labor shall fall within the scope of protection of the present invention. It will be appreciated that the accompanying drawings are provided for reference and illustrative purposes only and are not intended to limit the present invention. The connections shown in the accompanying drawings are only for the convenience of clear description and do not limit their connection methods.

It should be noted that when a component is considered to be "connected" to another component, it may be directly connected to another component, or it may also have a centered component between them. Unless otherwise defined, all technical and scientific terms used herein have the same meaning as commonly understood by the person of ordinary skill in the art of the present invention. It also should be noted that, unless otherwise expressly provided and limited, the terms "mounted", "connected", "attached" are to be understood in a broad sense, for example, it may be a fixed connection, a detachable connection, or an integral connection. It may also be a mechanical connection, an electrical connection, or a connection inside of two elements. For the person of ordinary skill in the art, the specific meaning of the above terms in the context of the present disclosure may be understood in specific situations. The terms used herein in the specification of the present disclosure are used only for the purpose of describing specific embodiments and are not intended to limit the present invention.

It also should be noted that, in the description of the present disclosure, the terms "center", "up", "down", "left", "right", "vertical", "horizontal", "inside", "outside", etc. indicating orientations or positional relationships are based on those shown in the accompanying drawings and are intended only to facilitate and simplify the description of the present disclosure, but not to indicate or imply that a device or an element referred to must have a particular orientation, be constructed and operated in a particular orientation, and therefore are not to be construed as a limitation of the present disclosure. Furthermore, the terms "first", "second", and "third" are used for descriptive purposes only but not to be understood as indicating or implying relative importance.

Figure 1:
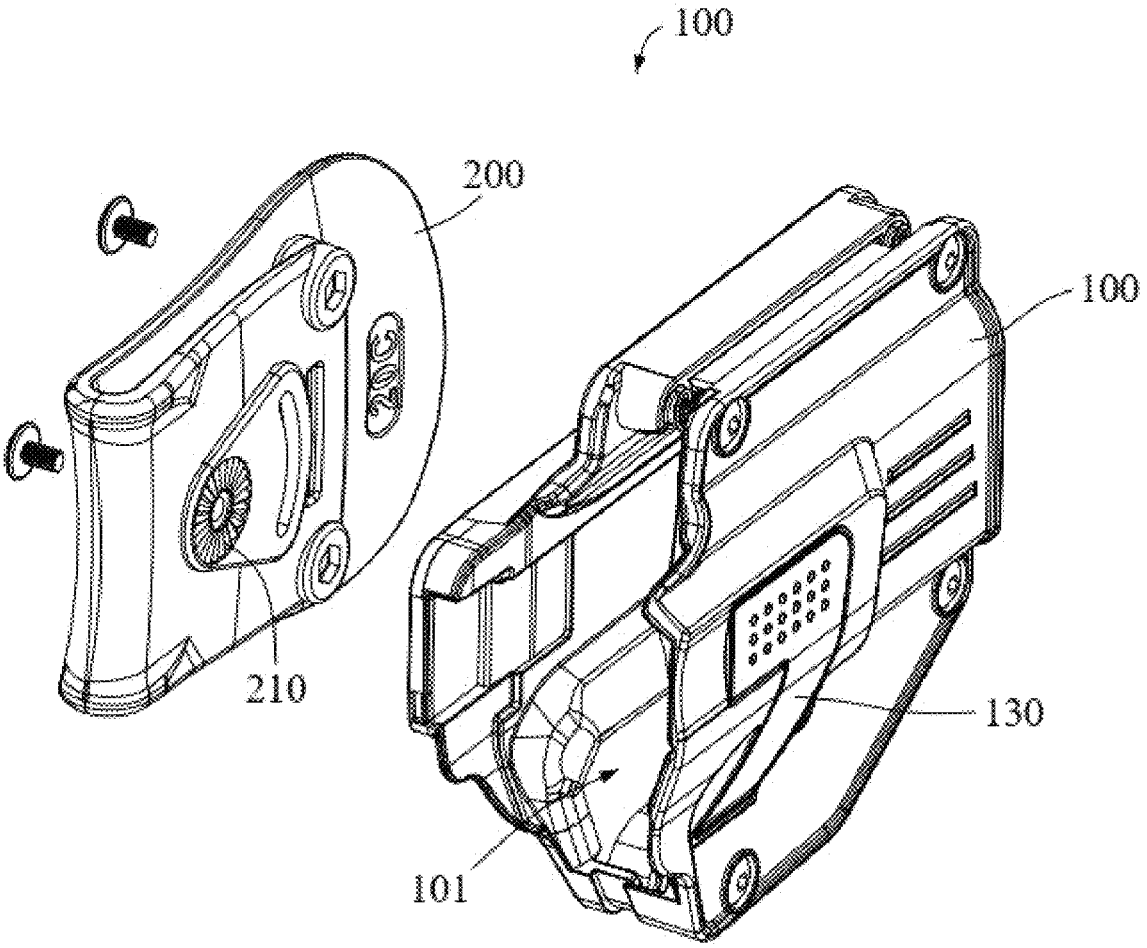
FIG. 1 shows a structure schematic diagram in a first view of a universal holster in accordance with some specific embodiments of the present disclosure.
Figure 2:
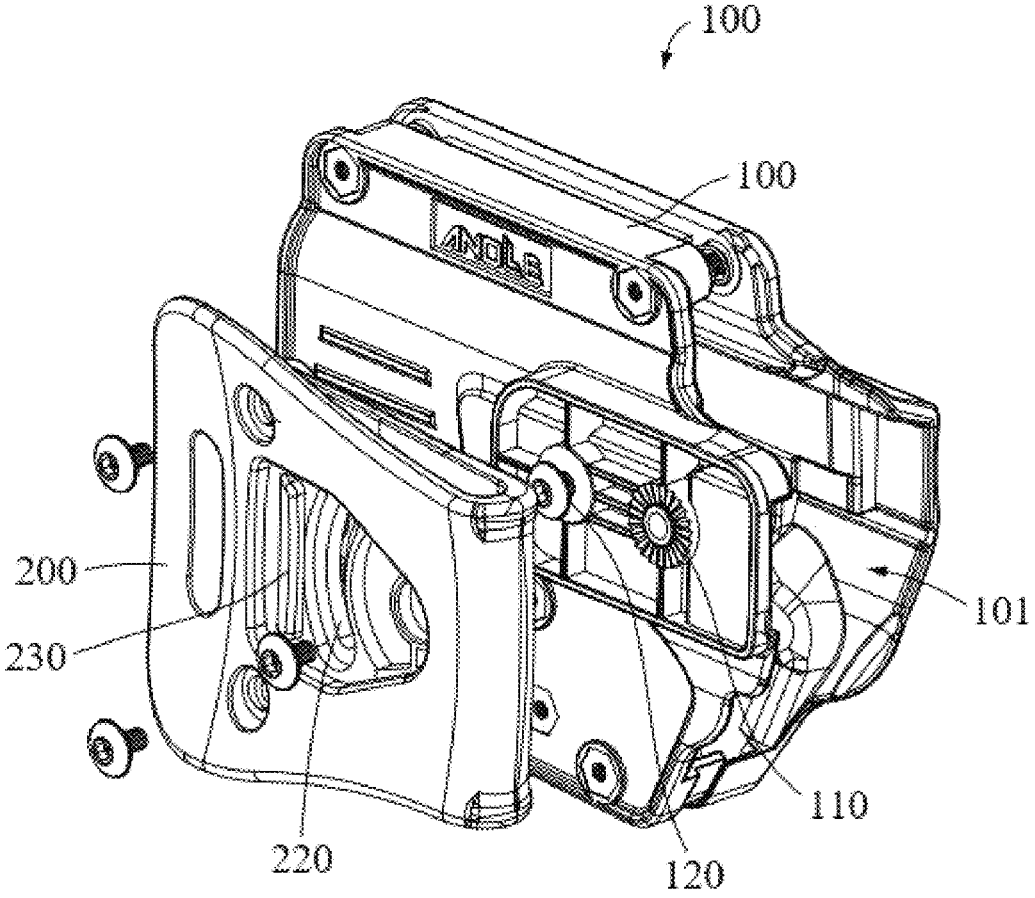
FIG. 2 shows a structure schematic diagram in a second view of the universal holster in accordance with some specific embodiments of the present disclosure.

Referring to FIG. 1 and FIG. 2, in some specific embodiments of the present disclosure, a universal holster 300 is provided. The universal holster 300 includes a sleeve body 100 and a buckle clip 200. Herein the buckle clip 200 is attached with the sleeve body 100, the buckle clip 200 can be fastened to a user's belt, and the sleeve body 100 has a chamber 101, the chamber 101 is available for the insertion of a pistol.

The buckle clip 200 is rotationally connected with the sleeve body 100, the buckle clip 200 is provided with a first tooth ring 210, the sleeve body 100 is provided with a second tooth ring 110, and the first tooth ring 210 is fitted with the second tooth ring 110, so that there is a resistance when the sleeve body 100 is rotated relative to the buckle clip 200. The sleeve body 100 is provided with a pin 120, the buckle clip 200 is provided with an arc hole 220, and the pin is inserted into the arc hole 220 to facilitate angle adjustment of the sleeve body 100.

A barrier strip 230 may also be provided on the inside of the buckle clip 200, the barrier strip 230 is used to limit the belt in the buckle clip 200 to prevent the buckle clip 200 from wobbling. The belt can be placed through the buckle clip 200 or can be propped open to place the belt into the buckle clip 200 through an opening in the buckle clip 200.

The sleeve body 100 is provided with a lock latch 130, and when the pistol is inserted into the sleeve body 100, the lock latch 130 fastens the trigger ring of the pistol, thereby securing the pistol within the sleeve body 100. And after pressing the lock latch 130, the lock latch 130 unlocks, the pistol can be thus pulled out of the sleeve body 100.

To keep the pistol stable within the sleeve body 100 and to avoid adverse effects of the wobbles of the pistol, it is necessary to make the chamber 101 of the sleeve body 100 match with the model of the pistol. In this regard, an adjustable component can be mounted on the sleeve body 100 so that the pistol can be abutted against the chamber 101 when the pistol is inserted into the sleeve body 100, thereby allowing the pistol been secured in place to minimize wobble.

Figure 3:
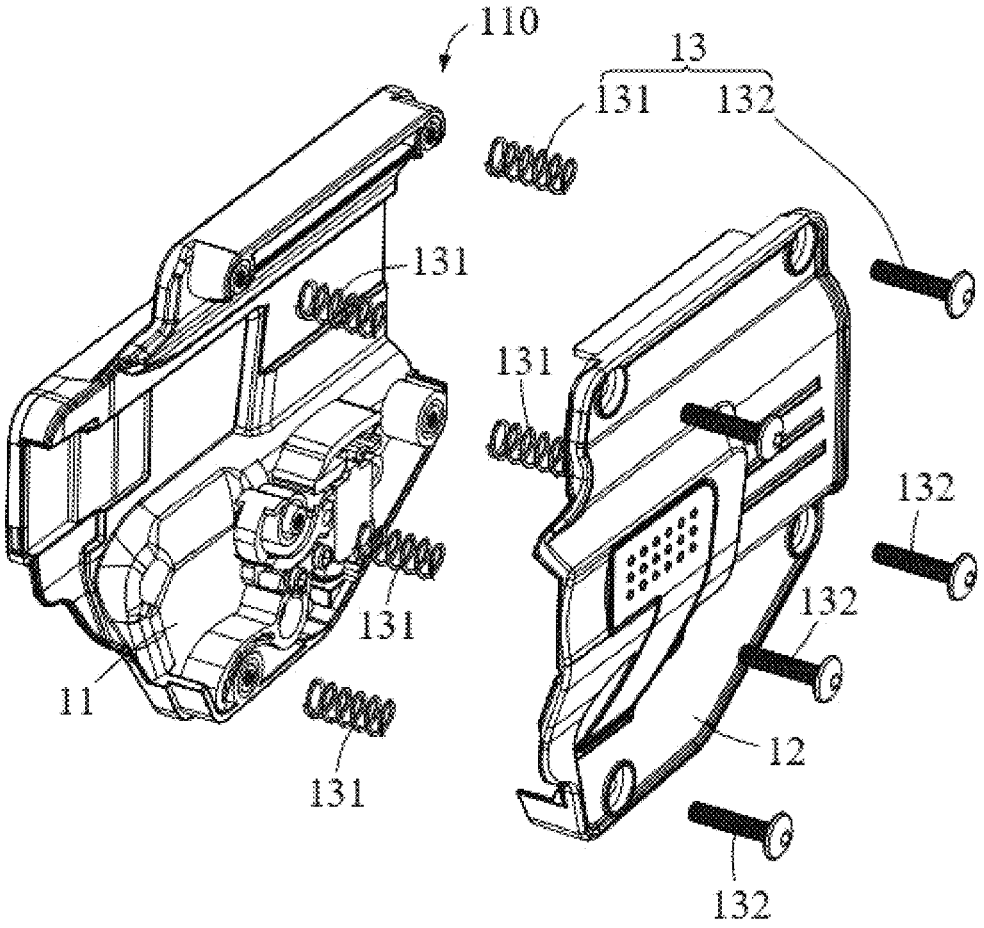
FIG. 3 shows an exploded view of a sleeve body of the universal holster in accordance with some specific embodiments of the present disclosure.

Specifically, referring to FIG. 3, the sleeve body 100 includes a first housing 11 and a second housing 12, the chamber 101 is defined between the first housing 11 and the second housing 12. The first housing 11 and the second housing 12 are connected by means of a plurality of elastic adjustable components 13. More specifically, the elastic adjustable components 13 each includes an elastic part 131 and an adjustable lever 132. Herein the elastic part 131 may be a rubber elastic post or may be a spring, the adjustable lever 132 may pass through the second housing 12 and the elastic part 131 and then be connected to the first housing 11, and the adjustable lever 132 may choose a screw. The elastic part 131 is abutted against the first housing 11 and the second housing 12, and when the adjustable lever 132 is adjusted, the width of the chamber 101 can be adjusted under an action of the elastic part 131, which in turn can make the sleeve body 100 to adapt to different widths of the pistol.

Figure 4:
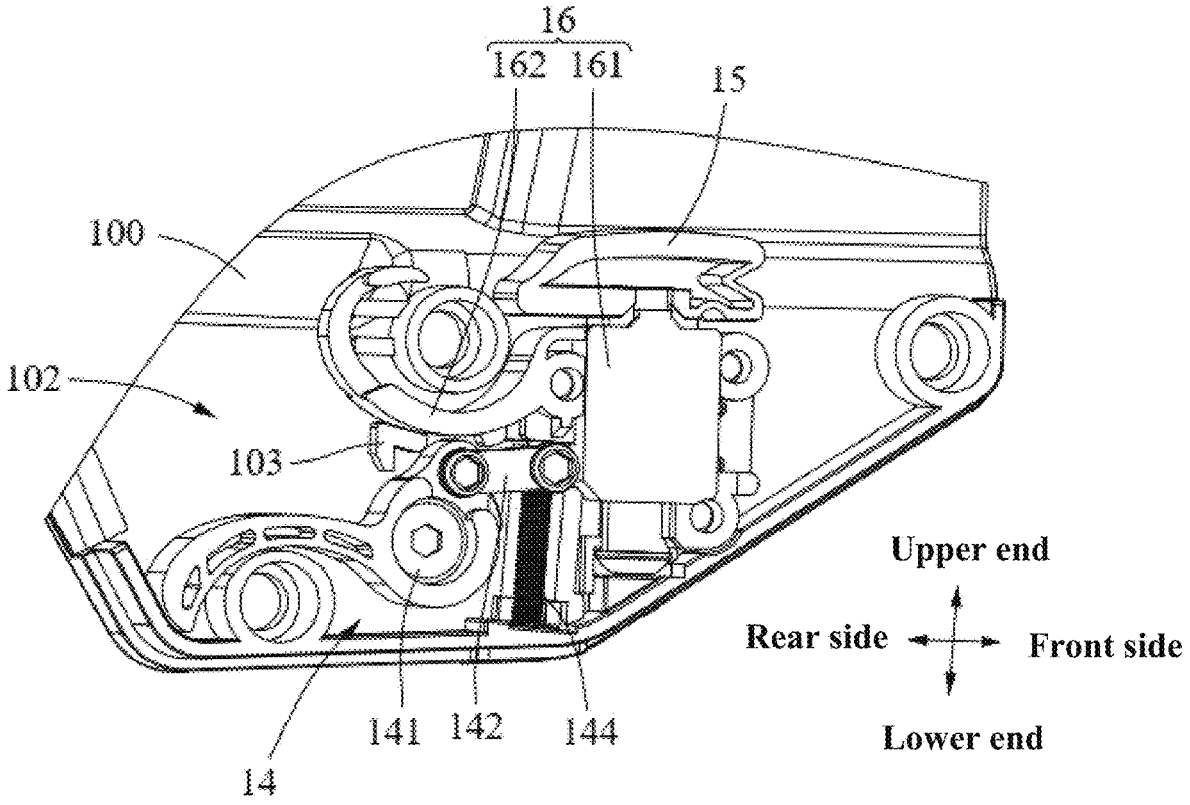
FIG. 4 shows a structure schematic diagram in a third view of the sleeve body, a first adjustable component, a second adjustable component and a third bracket of the universal holster in accordance with some specific embodiments of the present disclosure.
Figure 5:
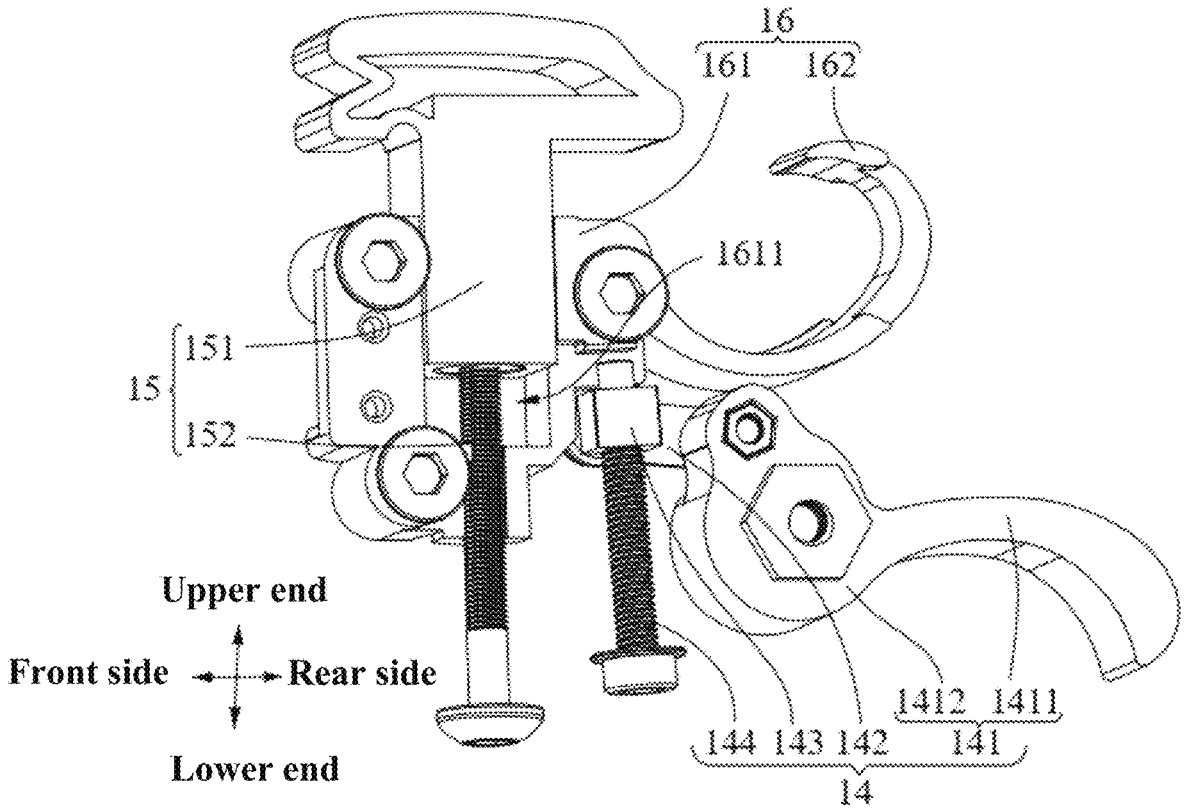
FIG. 5 shows a structure schematic diagram in a fourth view of the first adjustable component, the second adjustable component and the third bracket of the universal holster in accordance with some specific embodiments of the present disclosure.

Specifically, referring to FIG. 4 and FIG. 5, the sleeve body 100 may also be fitted with a first adjustable component 14, the first adjustable component 14 includes a first bracket 141, a connecting rod 142, a movable part 143 and an adjustable part 144. Herein the first bracket 141 is rotationally connected with respect to the sleeve body 100, and the first bracket 141 may be mounted on the first housing 11. One end of the connecting rod 142 is rotationally connected to the first bracket 141, a rotational connection point between the connecting rod 142 and the first bracket 141 is eccentric to a rotational connection point between the first bracket 141 and the sleeve body 100. And another end of the connecting rod 142 is rotationally connected to the movable part 143, the adjustable part 144 is connected with the movable part 143, and the adjustable part 144 is configured to drive the movable part 143 for movement.

By adjusting the adjustable part 144 to drive the movable part for movement, thereby making the connecting rod 142 movable. The connecting rod 142 will drive the first bracket 142 to rotate relative to the sleeve body 100 during moving; in turn the angles of the first bracket 141 can be adjusted so that the first bracket 141 can be made to abut against different models of pistol. Thus the universal holster of the present disclosure can be suitable for different models of the pistol.

The adjustable part 144 may be a first bolt 144, and the first bolt 144 is threaded with the movable part 143. During adjustment, the movable part 143 moves when the first bolt 144 is screwed to rotate.

By using the first bolt 144 as the adjustable part 144, the stability of the first bracket 141 can be improved. Specifically, the pistol is inserted into the sleeve body 100, the pistol will give a certain pressure to the first bracket 141, so that the first bracket 141 has a tendency to reverse, which in turn will give a certain tension to the connecting rod 142, and also will give a certain tensile force to the movable part 143. And since the first bolt 144 is threadedly connected with the movable part 143, tension transmitted along the connecting rod 142 will form a certain angle with the first bolt 144, and therefore the tension transmitted along the connecting rod 142 is less likely to cause the movable part 143 to shift relative to the first bolt 144. Therefore, the first bolt 144 is used as the adjustable part 144, and when the first bracket 141 is adjusted to a suitable angle, the pistol is inserted into the sleeve body so that the pistol exerts a certain pressure on the first bracket 141, the first bracket 141 is less likely to rotate and thus the stability of the first bracket 141 can be improved.

It should be understood that the first bracket 141 may be used to abut against a desired position of the pistol, for example, it may be to abut against a trigger ring of the pistol, or the bottom side of the trigger ring, or the front side of the trigger ring, and it may also be to abut against the barrel of the pistol. In the specific embodiments of the present disclosure, the first bracket 141 is used to abut against the bottom side of the trigger ring of the pistol.

For example, the front side of the trigger ring of the pistol is empty, but the rear side of the trigger ring generally has a handle, and a lower end of the handle is lower than the bottom side of the trigger ring, after the pistol is inserted into the holster, in order to facilitate drawing of the pistol out of the holster, the handle of the pistol is exposed outside of the sleeve body 100 so as to be held by the user. Therefore, the lower end of the sleeve body 100 cannot be too long, otherwise it would block the handle, so that the space at the lower end of the sleeve body 100 is limited.

Therefore, the specific embodiments of the present disclosure are further provided the following. The first bracket 141 includes an abut portion 1411 and a connecting portion 1412. The abut portion 1411 is used to abut against the pistol, which can abut against the bottom side of the trigger ring of the pistol or other positions. The connecting portion 1412 is rotationally connected with the sleeve body 100, the abut portion 1411 is connected with the connecting portion 1412 and located on a rear side of the connecting portion 1412. Another end of the connecting rod 142 extends a front side, and the adjustable part 144 is located on the front side of the connecting portion 1412. In this way, it allows the connecting portion 1412, the connecting rod 142, the movable part 143 and the adjustable part 144 to be arranged at the front side of the trigger ring space 102 of the sleeve body 100, instead of being arranged directly below the trigger ring space 102, thus the length of the lower end of the sleeve body 100 can be reduced.

Further referring to FIG. 4 and FIG. 5, the sleeve body 100 may also be fitted with the second adjustable component 15, and the second adjustable component 15 is used to abut against the barrel of the pistol. Specifically, the second adjustable component 15 includes a second bracket 151 and a second bolt 152. The second bracket 151 is threadedly connected with the second bolt 152, by screwing the second bolt 152, the second bracket 152 is driven to move by the second bolt 152, so as to adjust the position of the second bracket 151 in the sleeve body 100, and thus to adapt to different models of pistol. The second adjustable component 15 may be located at the front side of the trigger ring space 102 of the sleeve body 100.

Further referring to FIG. 4 and FIG. 5, the sleeve body 100 may also be fitted with a third bracket 16, the third bracket 16 is used to abut against the front side of the trigger ring of the pistol. Herein the third bracket 16 may include a guide portion 161 and an elastic arm 162.

The guide portion 161 is secured with the sleeve body 100, the guide portion 161 is provided with a guide slot 1611, and the second bracket 151 is inserted into the guide slot 1611 and also slidingly connected to the guide portion 161. The guide slot 1611 is used to limit the rotation of the second bracket 151 so that the third bracket 16 can move only along the guide slot 1611. The second bracket 151 is guided by the third bracket 16, which increases the use of the third bracket 16.

The elastic arm 162 is attached with the guide portion 161 and located on a rear side of the guide portion 161, and the elastic arm 162 is used to abut against the front side of the trigger ring space of the pistol.

The sleeve body 100 is also provided with a baffle wall 103, the baffle wall 103 is used to limit a deformation degree of the elastic arm 162 as well as limit a rotation angle of the first bracket 141, and thus the baffle wall 103 has dual functions.

In the specification and claims of the present disclosure, the words "comprise/comprising" and the words "include/including" and variations thereof are used to designate the presence of the stated feature, value, step, or component, but do not preclude the presence of, or addition of, one or more other features, values, steps, components, or combinations thereof.

Some features of the present disclosure, are, for the purpose of clarity of exposition, described in separate embodiments respectively. However, these features may also be described in combination in a single embodiment. Conversely, some features of the present disclosure are, for the purpose of brevity, described in a single embodiment only. However, these features may also be described in separate embodiments or in any suitable combination.

The foregoing description is only some preferred embodiments of the present disclosure and is not intended to limit the present invention. Any modifications, equivalent substitutions and improvements made within the concept and principles of the present disclosure shall be covered in the scope of protection of the present invention.

What is claimed is:

1. A universal holster, comprising:

a sleeve body having a chamber; and a first adjustable component, comprising a first bracket, a connecting rod, a movable part and an adjustable part; and wherein the first bracket is rotationally connected with respect to the sleeve body and one end of the connecting rod is rotationally connected to the first bracket, a rotational connection point between the connecting rod and the first bracket is eccentric to a rotational connection point between the first bracket and the sleeve body, another end of the connecting rod is rotationally connected to the movable part, the adjustable part is connected with the movable part, and the adjustable part is configured to drive the movable part for movement.

2. The universal holster according to claim 1, wherein the first bracket is configured to abut against bottom side of a trigger ring of a pistol.

3. The universal holster according to claim 2, wherein the adjustable part is a first bolt and the first bolt is threaded with the movable part.

4. The universal holster according to claim 2, wherein the first bracket comprises an abut portion and a connecting portion, the connecting portion is rotationally connected with the sleeve body, the abut portion is connected with the connecting portion and located on a rear side of the connecting portion, the another end of the connecting rod extends toward a front side, and the adjustable part is located on a front side of the connecting portion.

5. The universal holster according to claim 1, further comprising a second adjustable component configured to abut against a barrel of the pistol.

6. The universal holster according to claim 5, wherein the second adjustable component comprises:

a second bracket; and a second bolt; and wherein the second bracket is threadedly connected with the second bolt to drive the second bracket moving by means of the second bolt.

7. The universal holster according to claim 2, further comprising a third bracket configured to abut against front of the trigger ring of the pistol.

8. The universal holster according to claim 7, wherein the third bracket comprises:

a guide portion, configured to secure the sleeve body; the guide portion is provided with a guide slot, and the second bracket is inserted in the guide slot and slidingly connected to the guide portion; and an elastic arm, attached with the guide portion and located on a rear side of the guide portion.

9. The universal holster according to claim 8, wherein the sleeve body is provided with a baffle wall, the baffle wall is configured to limit a deformation degree of the elastic arm as well as limit a rotation angle of the first bracket.

10. The universal holster according to claim 1, wherein the sleeve body comprises:

a plurality of adjustable components, and the adjustable components each comprises an elastic part and an adjustable lever;

a first housing; and a second housing; and wherein the second housing is connected to the first housing by means of the adjustable lever, the elastic part is abutted against the first housing and the second housing, and the adjustable lever is configured to adjust a width of the chamber.

11. The universal holster according to claim 1, further comprising a buckle clip, the buckle clip is rotationally connected with the sleeve body, the buckle clip is provided with a first tooth ring, the sleeve body is provided with a second tooth ring, and the first tooth ring is fitted with the second tooth ring.

* * * * *